US006566848B2

(12) United States Patent
Horigan et al.

(10) Patent No.: US 6,566,848 B2
(45) Date of Patent: May 20, 2003

(54) AUTO-CALIBRATING VOLTAGE REGULATOR WITH DYNAMIC SET-POINT CAPABILITY

(75) Inventors: John W. Horigan, Mountain View, CA (US); Daniel F. Gilbride, San Jose, CA (US); Don J. Nguyen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/749,090

(22) Filed: Dec. 26, 2000

(65) Prior Publication Data

US 2002/0079874 A1 Jun. 27, 2002

(51) Int. Cl.[7] ..... G05F 1/40; H05B 1/02
(52) U.S. Cl. ..... 323/283; 323/284; 219/492
(58) Field of Search ..... 323/283, 281, 323/282, 284, 273; 219/137 PS, 130.33, 130.31, 130.32, 130.21, 492

(56) References Cited

U.S. PATENT DOCUMENTS 3,532,960 A * 10/1970 Webb ..... 363/30
4,419,619 A * 12/1983 Jindrick et al. ..... 323/257
5,408,067 A * 4/1995 Crouse ..... 219/137 PS
5,498,882 A 3/1996 Houston
5,559,368 A 9/1996 Hu et al.
5,670,070 A * 9/1997 Clark et al. ..... 219/130.33
5,675,480 A * 10/1997 Stanford ..... 363/21.1
5,753,955 A 5/1998 Fechner
5,942,781 A 8/1999 Burr et al.
6,031,261 A 2/2000 Kang
6,249,027 B1 6/2001 Burr
6,293,471 B1 * 9/2001 Stettin et al. ..... 219/492

OTHER PUBLICATIONS

Assaderaghi, F., Sinitsky, D., Parke, S., Bokor, J., Ko, P. and Hu, C., "A Dynamic Threshold Voltage MOSFET (DTMOS) for Ultra–Low Voltage Operation", Department of Electrical Engineering and Computer Science, 1994 IEEE, pp. 33.1.1–33.1.4, University of California at Berkeley, Berkeley, California 94720. No date.

Wann, C., Assaderaghi, F., Dennard, R., Hu, C., Shahidi, G. and Taur, Y., "Channel Profile Optimization and Device Design for Low–Power High–Performance Dynamic–Threshold MOSFET", 1996 IEEE, pp. 5.3.1–5.3.4, IBM T.J. Watson Research Center, Yorktown Heights, New York 10598, University of California at Berkeley, Berkeley California 94750. No date.

Kuehne, C., et al., "SOI MOSFET with Buried Body Strap by Wafer Bonding" IEEE Transaction on Electronic Devices, vol. 45, No. 5, May 1998, 8 pages.

Kuehne, S., et al., "Deep Sub–Micron SOI Mosfet With Buried Body Strap" IEEE International SOI conference, Oct. 1996, 2 pages.

* cited by examiner

*Primary Examiner*—Rajnikant B. Patel
(74) *Attorney, Agent, or Firm*—Blakely, Sokoloff, Taylor & Zafman LLP

(57) ABSTRACT

A voltage regulator is described which uses external resistors to set a load line and offset. During initial operation and also during normal operation the load line and offset are reset by placing, for instance, the microprocessor in a high active state, low active state and in a sleep mode. By dynamically changing the load line and offset voltage, minimum current is drawn thus extending battery life.

51 Claims, 4 Drawing Sheets

AUTO-CALIBRATING VOLTAGE REGULATOR WITH DYNAMIC SET-POINT CAPABILITY

BACKGROUND OF THE INVENTION

1. Field of the Invention

The invention relates to the field of power supplies and voltage regulators for microprocessors and the like.

2. Prior Art and Related Art

Voltage regulators sometimes use external resistors to assure a predetermined load line and offset voltage. For instance, the set-points assure that at low activity during an active mode, Vcc approximates the maximum power supply voltage for the microprocessor, and at maximum current load the regulator provides the minimum acceptable Vcc to the microprocessor. The resistors also provide the offset potential that allow the correct voltage for sleep modes to compensate for leakage over the operating temperature range of the microprocessor.

These resistors are often selected based on the worse case part. As a practical matter, a voltage regulator for a given platform may be tuned to the highest frequency part that will be used in that platform. This reduces the efficiency since the load line and offset voltage are usually non-optimal for a given processor.

Whenever the load line is not optimal, more power than necessary is consumed. This is particularly important for microprocessor in mobile personal computers since it shortens battery life.

See U.S. Pat. No. 5,926,394 and co-pending application Ser. No. 09/148,033; filed Sep. 3, 1998; entitled, "Method and Apparatus for Reducing the Power Consumption of a Voltage Regulator" assigned to the assignee of the present invention.

DETAILED DESCRIPTION OF THE PRESENT INVENTION

A method for operating a voltage regulator is disclosed which dynamically adjusts the load line and offset voltage. In the following description, numerous specific details are set forth such in order to provide a thorough understanding of the present invention. It will be apparent to one skilled in the art that the present invention may be practiced without these details. In other instances, well-known circuits, such as voltage regulator circuits, have not been set forth in detail in order not to unnecessarily obscure the present invention.

Figure 1:
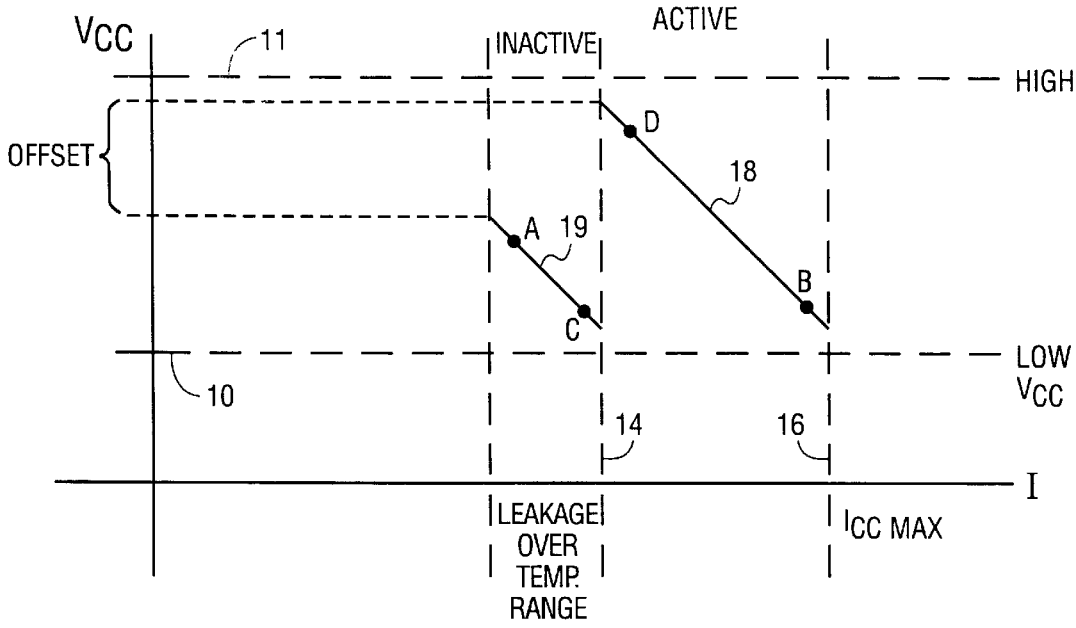
FIG. 1 is a diagram illustrating load lines both for an active and inactive state of a microprocessor.

Referring to FIG. 1, typical load lines 18 and 19 for a microprocessor are illustrated. The dotted line 10 represents the lowest Vcc that the microprocessor should operate under and the line 11 shows the maximum Vcc for the microprocessor. During the microprocessor's active state, shown between the vertical lines 14 and 16, load line 18 is followed by the voltage regulator. This load line begins slightly above line 10 and ends slightly below line 11 in order to provide some safety margin which takes into account the tolerances of the voltage regulator. At the high current end of line 18, the microprocessor is operating at a very high rate. Such a rate may be forced for testing with a virus. At the low current end of line 18, the microprocessor is operating at a low level of operation for instance, perhaps doing simple word processing.

Line 19 illustrates the load line for the inactive period, that is for instance, during a sleep mode. In this mode, generally the microprocessor clock is off and only leakage current needed to sustain states in registers is flowing. The minimum and maximum currents for load line 19 cover the leakage over the operating temperature range. At the high current end of the current (line 14) high leakage occurs at a higher temperature. In contrast, at the other end of line 19, lower current flows typically representing lower leakage at a lower temperature.

The voltage difference between the limits of the load lines 18 and 19 is the offset potential representing the drop in potential from the voltage regulator when the microprocessor enters sleep mode. As described in the above-referenced application, a signal may be applied to the voltage regulator to alert it to a transition from the inactive mode to the active mode to enable the regulator to provide the sudden step up in potential required when entering the active mode from the inactive mode.

Figure 2:
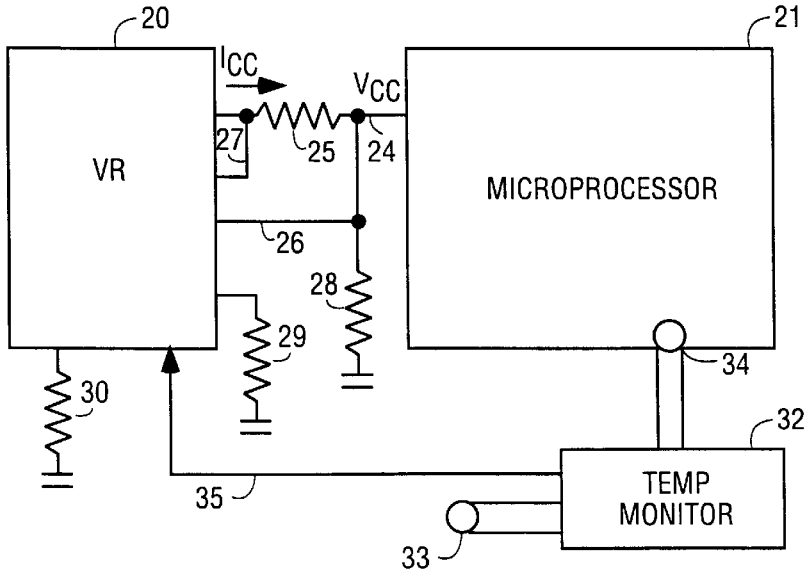
FIG. 2 is a block diagram of a voltage regulator and microprocessor illustrating external resistors and temperature monitoring.

In FIG. 2 the voltage regulator 20 is illustrated which provides a potential Vcc on line 24 to the microprocessor 21. A first resistor 25 allows the current to be measured by the potential between lines 26 and 27. Other external resistors, such as resistors 28, 29 and 30 allow for other parameters of the voltage regulators to be set such as the offset voltage.

As will be seen, in one embodiment of the present invention, temperature monitoring occurs by the temperature monitor 32 which monitors system (ambient) temperature with the sensor 32 and the microprocessor (die) temperature with the sensor 34. These temperatures are used by the voltage regulator, in one embodiment, and hence are coupled to the voltage regulator by line 35.

Typically the load lines of FIG. 1 are set by the external resistors. As taught by the present invention these load lines are initially adjusted and may be recalibrated during operation.

Figure 4:
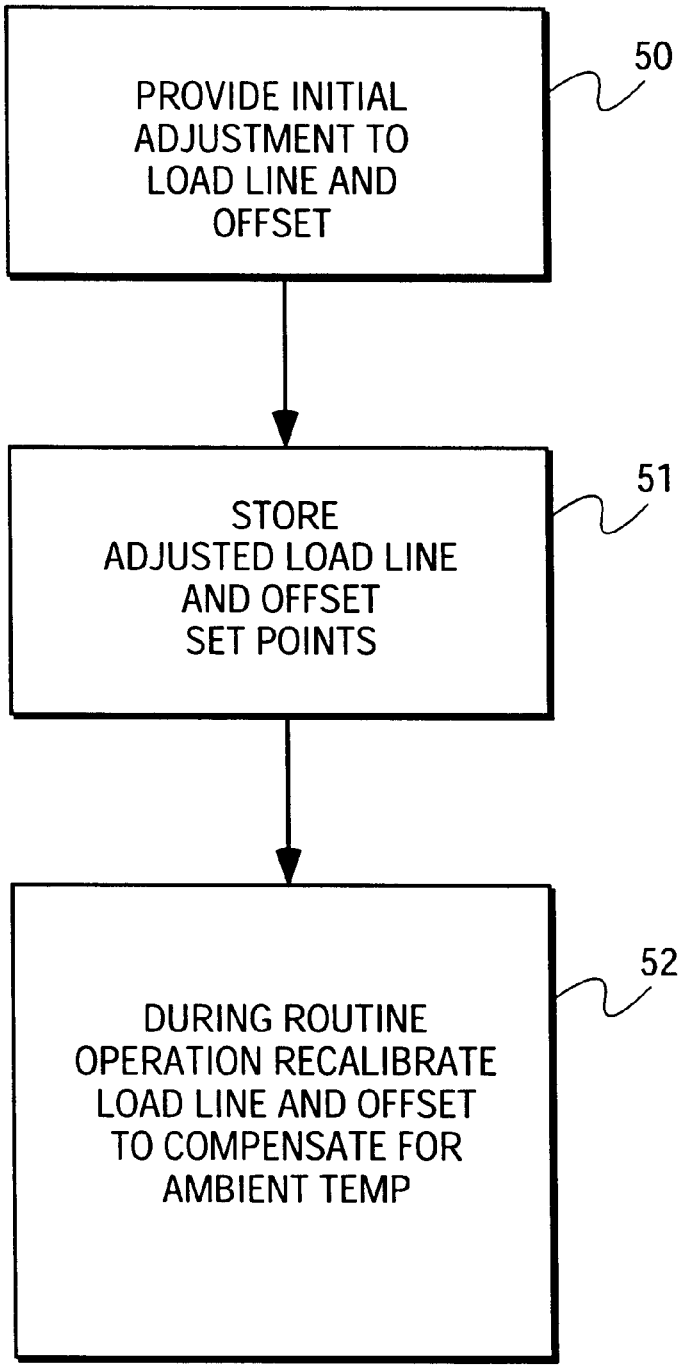
FIG. 4 illustrates the steps for initially adjusting and recalibrating the load line and offset voltage.

Referring briefly now to FIG. 4, step 50 illustrates the providing of an initial load line and offset voltage adjustment based on the characteristics of the particular microprocessor being used. This may occur for instance, when the microprocessor is first booted up in a particular platform and may occur only once, although it can occur each time the microprocessor is reset. Step 50 provides the data for adjusting the load line and offset voltage by, in effect, adding to or reducing the resistance of the external resistors. The data for providing these adjustments may be stored and used each time the microprocessor is reset as shown by step 51.

Step 52, on the other hand, illustrates recalibrating the load line and offset to compensate for the system temperature on a routine basis once the microprocessor is operating. The results of this recalibration is typically not stored, but rather are recomputed with some regularity. For example, each time the microprocessor enters a sleep mode, a software program may cause the microprocessor to go into a high active state and a low active state. During both these states the current is measured and load line recalibrated. Additionally at this time the leakage current is also measured so that load line 19 can be recalibrated.

Figure 5:
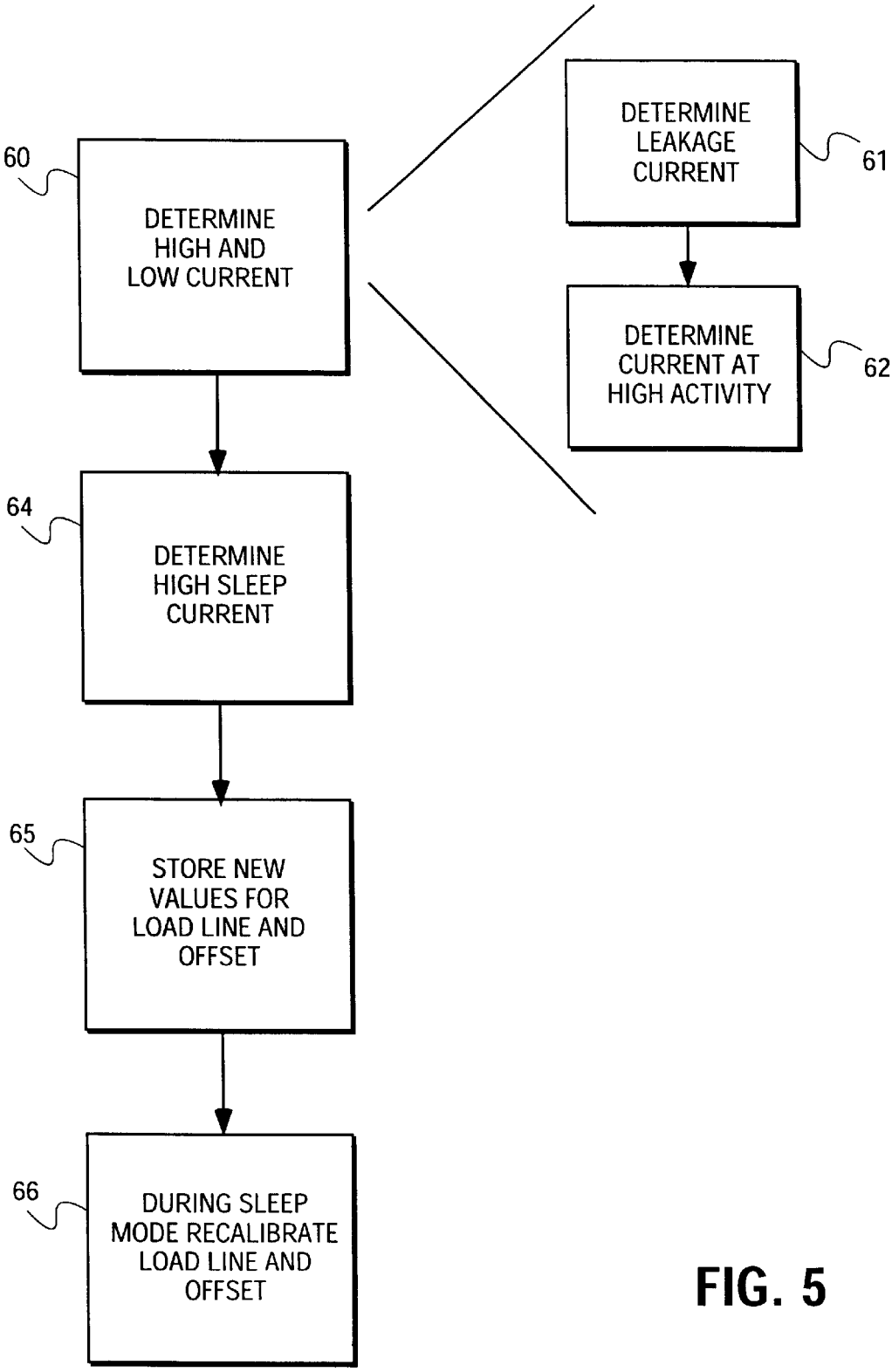
FIG. 5 illustrates the steps for determining a load line and offset voltage.

Referring now to FIG. 5, assume that the voltage regulator of FIG. 2 has preset load lines 18 and 19 which are determined by the external resistors. As shown by step 60, the microprocessor current is measured for one or more modes of operation. Steps 61 and 62 describe one manner in which this may be done. When the microprocessor is first started, the leakage current may be determined as shown by step 61. Since reset has just occurred, it can be assumed that the microprocessor is at its lowest temperature and thus the current for step 61 represents the lowest current for the load line 19. This is shown as point A on load line 19 of FIG. 3.

Now as shown by step 62, the microprocessor is caused to run at its highest activity state, for instance by receiving a specially designed "virus" routine. This operation, in one embodiment, occurs until the microprocessor reaches its maximum operating temperature (e.g. 100° C.) as determined by the sensor 34. When the temperature monitor 32 senses this temperature, the current through the resistor 25 is measured. This current represents the high current for the load line 18 and is shown, by way of example, as point B on load line 18.

Now as shown by step 64, point C of load line 19 can be determined. Since the microprocessor is at its maximum temperature, the maximum leakage current can be determined.

With set-points A, B and C a new load line and offset voltage can be readily determined which, in effect, adjusts the load lines 18 and 19 of FIG. 1. These values can be stored and provide new load lines 40 and 41 illustrated of FIG. 3. As shown, the new load line 40 has less maximum current; also the new load line 41 allows for a larger offset voltage. This helps reduce the overall power consumed by the microprocessor and thus allow for extended battery life.

As shown by step 65, these values are stored and may be used each time the microprocessor is reset. Typically as shown by step 66, the load line is adjusted by the regulator during a sleep mode to prevent any transients from occurring or the load line can be set upon reset.

While in the above example, points A, B and C were determined, other points can be determined and used for adjusting and recalibrating the load line. For instance, upon the initial operation of the microprocessor as mentioned above, its temperature is presumably as low as it will be for a given ambient condition. At this time, the microprocessor may be put into an active mode but with low activity and for instance, a point D of FIG. 1 determined. Other combinations of active and inactive states can be used to determine set-points for the load lines and offset voltage.

During normal operation the load lines can be recalibrated as mentioned, for instance, each time microprocessor enters the sleep mode. When this occurs, it may not be desirable to determine point B of load line 18 (FIG. 1). Rather, point D may be determined since this does not require the high active rate associated with point B. Point D may be used to determine the offset voltage for the then current operating temperature. If the recalibration occurs relatively frequently, for instance within the thermal time constant of the microprocessor, the operating currents can be determined as temperature varies. Additionally, a temperature reading from the sensor 33 may be used in conjunction with data representing the line 41 of FIG. 3 to reposition the offset voltage and for the matter to redetermining line 40 based on stored recalibration data for different operating temperatures. This can be done for either or both the ambient temperature and die temperature.

Figure 3:
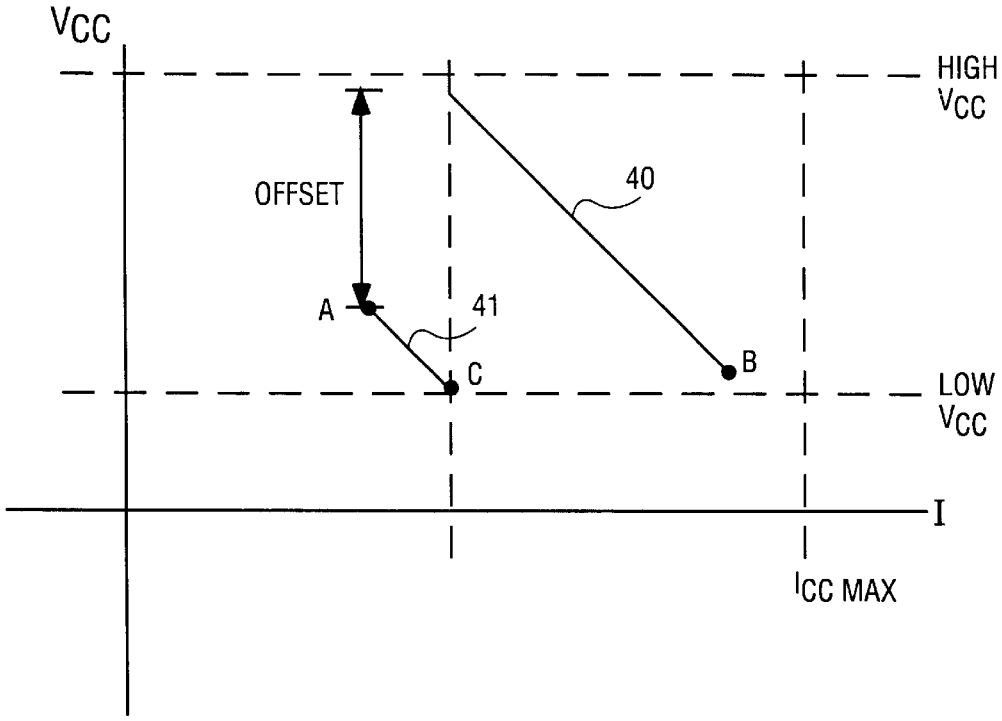
FIG. 3 is a diagram illustrating load lines where the load lines have been adjusted based on the characteristics of a microprocessor.

In another embodiment, where the load line 40 of FIG. 3 is computed regularly, point B can be determined by bringing the microprocessor to a high active state momentarily (a few microseconds) and then to a low active state for a few microseconds to determine point D of line 40. These points are all that is needed for this load line since recalibration occurs within the thermal time constant of the microprocessor. The high activity rate for point B can use a software program other than the virus mentioned above which causes the microprocessor to draw high current. When this is done most interrupts are disabled to assure high current draw during the few microseconds required to determine this point.

Thus, a voltage regulator has been described which adjusts and recalibrates a load line and offset voltage both upon initialization and during operation.

What is claimed is:

1. A method for operating a voltage regulator for a microprocessor comprising:

causing the microprocessor to enter two different levels of activity;

measuring a current for each of the levels; and setting a load line of the voltage regulator based on the currents.

2. The method defined by claim 1 wherein a current measurement is made during an inactive period and used to set an offset voltage.

3. The method defined by claim 1 wherein during one of the levels of activity the microprocessor is operated such that it reaches approximately its maximum operating temperature.

4. The method defined by claim 1 wherein the step of causing the microprocessor to enter two different levels of activity is regularly repeated.

5. The method defined by claim 3 wherein the regularity of causing the microprocessor to enter two different levels of activity is less than a thermal time constant of the microprocessor.

6. The method defined by claim 1 wherein the regularity of causing the microprocessor to enter two different levels of activity occurs under software control.

7. The method defined by claim 5 wherein the regularity of causing the microprocessor to enter two different levels of activity occurs under software control.

8. The method defined by claim 6 wherein at least one of the levels of activity occurs with some interrupts disabled.

9. The method defined by claim 7 wherein the at least one of the levels of activity occurs with some interrupts disabled.

10. The method defined by claim 1 wherein one of the levels of activity is a sleep mode.

11. The method defined by claim 9 wherein one of the levels of activity is a deep sleep mode.

12. The method defined by claim 1 including: monitoring the temperature of the microprocessor; and adjusting the load line based on the microprocessor temperature.

13. The method defined by claim 1 including: monitoring the ambient temperature; and adjusting the load line based on the ambient temperature.

14. The method defined by claim 1 wherein the voltage regulator receives a signal to assist in transitioning from a low power state to a higher power state.

15. A method for operating a voltage regulator for a microprocessor comprising:

causing the microprocessor to operate at a high level of operation and a low level of operation;

measuring a current flow for the high level of operation and low level of operation; and setting an offset voltage based on the current flows.

16. The method defined by claim 15 wherein the slope of a load line is set based on the current flows.

17. The method defined by claim 16 wherein the step of operating the microprocessor at a high level of operation and a low level of operation is regularly repeated.

18. The method defined by claim 16 wherein the regularity of the repeated high level and low level of operation is less than the thermal time constant of the microprocessor.

19. The method defined by claim 14 wherein at the high level of operation the microprocessor is allowed to operate at its maximum operating temperature.

20. A method for operating a voltage regulator for a microprocessor comprising;

periodically causing the microprocessor to operate at a high level of operation and at a low level of operation; and measuring a current flow for the high level of operation and the low level of operation;

setting a slope for a load line and an offset for a load line based on the measured current flows.

21. The method defined by claim 18 wherein the high level and low level of operation occur under software control.

22. The method defined by claim 19 wherein the high level and low level of operations occur with at least some interrupts disabled.

23. The method defined by claim 21 wherein the high level and low level operations occur for relatively short periods of time sufficient in length to allow the current flows to be measured.

24. A system comprising:

a microprocessor to enter two different levels of activity; and a unit to measure the current for each of the levels, and set a load line of the voltage regulator based on the currents.

25. The system defined by claim 24 wherein a current measurement is made during an inactive period and used to set an offset voltage.

26. The system defined by claim 24 wherein during one of the levels of activity the microprocessor is operated such that it reaches approximately its maximum operating temperature.

27. The system defined by claim 24 wherein the microprocessor entering two different levels of activity is regularly repeated.

28. The system defined by claim 26 wherein the regularity of causing the microprocessor to enter two different levels of activity is less than a thermal time constant of the microprocessor.

29. The system defined by claim 24 wherein the regularity of causing the microprocessor to enter two different levels of activity occurs under software control.

30. The system defined by claim 28 wherein the regularity of causing the microprocessor to enter two different levels of activity occurs under software control.

31. The system defined by claim 29 wherein at least one of the levels of activity occurs with some interrupts disabled.

32. The system defined by claim 30 wherein the at least one of the levels of activity occurs with some interrupts disabled.

33. The system defined by claim 29 wherein one of the levels of activity is a sleep mode.

34. The system defined by claim 3wherein one of the levels of activity is a deep sleep mode.

35. The system defined by claim 29, wherein the unit monitors the temperature of the microprocessor, and adjust the load line based on the microprocessor temperature.

36. The system defined by claim 29 wherein the unit monitors the ambient temperature, and adjust the load line based on the ambient temperature.

37. The system defined by claim 29 wherein the microprocessor receives a signal to assist in transitioning from a low power state to a higher power state.

38. A machine readable medium having stored thereon a set of instructions to perform a method comprising:

causing the microprocessor to enter two different levels of activity;

measuring the current for each of the levels; and setting a load line of the voltage regulator based on the currents.

39. The machine readable medium defined by claim 37 wherein a current measurement is made during an inactive period and used to set an offset voltage.

40. The machine readable medium defined by claim 37 wherein during one of the levels of activity the microprocessor is operated such that it reaches approximately its maximum operating temperature.

41. The machine readable medium defined by claim 37 wherein the step of causing the microprocessor to enter two different levels of activity is regularly repeated.

42. The machine readable medium defined by claim 39 wherein the regularity of causing the microprocessor to enter two different levels of activity is less than a thermal time constant of the microprocessor.

43. The machine readable medium defined by claim 37 wherein the regularity of causing the microprocessor to enter two different levels of activity occurs under software control.

44. The machine readable medium defined by claim 41 wherein the regularity of causing the microprocessor to enter two different levels of activity occurs under software control.

45. The machine readable medium defined by claim 42 wherein at least one of the levels of activity occurs with some interrupts disabled.

46. The machine readable medium defined by claim 43 wherein the at least one of the levels of activity occurs with some interrupts disable.

47. The machine readable medium defined by claim 37 wherein one of the levels of activity is a sleep mode.

48. The machine readable medium defined by claim 45 wherein one of the levels of activity is a sleep mode.

49. The machine readable medium defined by claim 37 including:

monitor the temperature of the processor; and adjusting the load line based on the microprocessor temperature.

50. The machine readable medium defined by claim 37 including:

monitoring the ambient temperature; and adjusting the load line based on the ambient temperature.

51. The machine readable medium defined by claim 37 wherein the voltage regulator receives a signal to assist in transitioning from a low power state to a higher power state.

* * * * *